United States Patent [19]

Craft et al.

[11] 4,006,688

[45] Feb. 8, 1977

[54] SHOT DISPERSION CONTROL DEVICE FOR SHOTGUN SHELLS

[76] Inventors: William J. Craft, Rte. 1, P.O. Box 668, Greensboro, N.C. 27406; Carroll B. Williams, P.O. Box 333, Banner Elk, N.C. 28604

[22] Filed: June 4, 1975

[21] Appl. No.: 583,600

[52] U.S. Cl. ..... 102/42 R

[51] Int. Cl.[2] ..... F42B 7/02

[58] Field of Search ..... 102/42 R, 42 C

[56] References Cited

UNITED STATES PATENTS

| | | | |
|---|---|---|---|
| 820,459 | 5/1906 | White | 102/42 R |
| 875,762 | 1/1908 | Winans et al. | 102/42 R |
| 1,941,336 | 12/1933 | Barbieri | 102/42 R |

FOREIGN PATENTS OR APPLICATIONS

| | | | |
|---|---|---|---|
| 473,162 | 9/1914 | France | 102/42 R |
| 1,096,547 | 2/1955 | France | 102/42 R |

*Primary Examiner*—Verlin R. Pendegrass

[57] ABSTRACT

A shot dispersion control device for use in shotgun shells having a base and a connected conical portion, which upon firing the shell, the dispersion control device exits the shotgun barrel simultaneously with the shot creating a more controlled, uniform and broader shot pattern than is normally delivered.

6 Claims, 8 Drawing Figures

Ø= 6.85°

Ø = 3.15°

SHOT DISPERSION CONTROL DEVICE FOR SHOTGUN SHELLS

BACKGROUND OF THE INVENTION

When shotguns were first manufactured in the 1800's little, if any, thought was directed to the shell construction as a method of controlling the shot pattern. Only the barrel lengths and barrel diameter were considered in attempts to control the shot in flight.

Later, Robert S. Elliott, in his U.S. Pat. No. 579,429 (1897), described a shot-distributing wad in an effort to enlarge the pattern of shot formed and to make the shot pattern more regular and evenly distributed. However, Elliott's device lacked a stabilizing member to insure uniform shot dispersion before and after exiting the gun muzzle.

Other inventors through the years have devised various forms of shot-spreaders and shot-holders in an effort to modify and control the flight pattern of the shot in its trajectory to the target. These devices have met with varying degrees of success, however, today, marksmen would readily accept a shell which would assure more consistent shot patterns being regularly delivered that has been previously available to them and which would eliminate either additional barrels or muzzle devices such as the "poly chokes" for controlling shot patterns. Also, since the shot dispersion control mechanism of this invention is contained within each shell, the marksman can readily predetermine and select the pattern size which will emerge as each particular shell is fired.

OBJECTS AND ADVANTAGES OF THE INVENTION

It is one of the objects of the present invention to provide a shot dispersion control device that will separate the shot upon discharge from the barrel of the gun to form an evenly distributed and uniform pattern.

Another purpose of this invention is to provide a shot dispersion control device that has a very short path of travel due to the large aerodynamic drag for quickly dispersing the shot of a shotgun shell.

Still another object of this invention is to provide a shot dispersion control device which can easily be modified during shell manufacture to provide different shot pattern sizes, and designated by suitable indicia to the hunter.

Yet another objective of this invention is to provide the hunter or marksman with shotgun shells which can be used in lieu of variable "choke" devices commonly mounted on shotgun barrels.

Other objects and advantages of this shot dispersion control will become readily apparent to those skilled in the art from the accompanying drawing and detailed description.

IN THE DRAWING

Figure 3A:
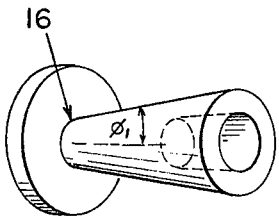
Figure 3B:
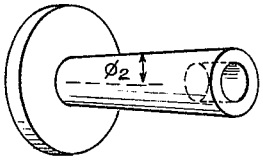
Figure 4A:
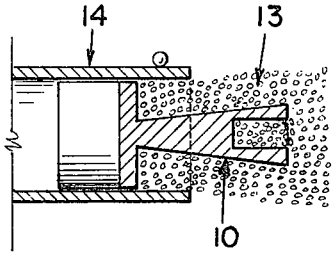
Figure 4B:
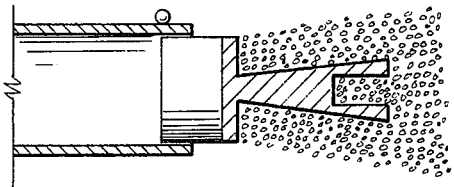

FIG. 3*a* is a perspective view of one form of a shot dispersion control device for a specific shot dispersion pattern;

FIG. 3*b* is a perspective view of a second embodiment of a shot dispersion control device for a different dispersion pattern;

FIGS. 4*a*., 4*b*., 4*c*., and 4*d*. demonstrate the shot and shot dispersion control device during a time sequence as it leaves the shotgun muzzle and in its flight trajectory.

DETAILED DESCRIPTION OF THE INVENTION

Figure 1:
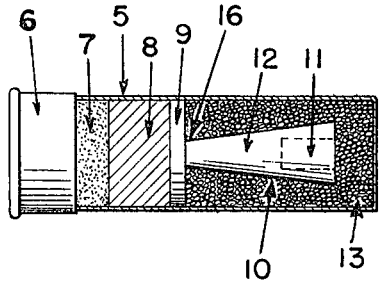
FIG. 1 is a partial longitudinal sectional view of a shotgun shell including a shot dispersion control device embodying our invention positioned therein.

Referring to the drawing and particularly to FIG. 1, the cylindrical body 5 of a shotgun shell is shown in juxtaposition to the base casing 6. The powder charge 7 is shown aft to the wadding 8, while the stability means 9 of the shot dispersion control device 10 is displayed in abutted relationship with wadding 8. The outer surface of shot dispersion control device 10 is shown with its longitudinal member 12 in frusto-conical configuration.

Figure 2:
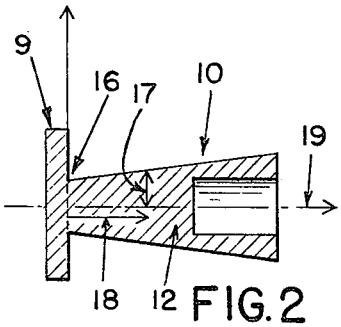
FIG. 2 is a cross-sectional view of a shot dispersion control device.

Referring to FIG. 2, the section radius 17 of the longitudinal member 12 generally increases beginning near the junction 16 of this member and stability means 9 and proceeding to the forward end of the dispersion control device 10. That is, the section radius 17 is generally a monotonically increasing function of the position 18 along the control device axis of symmetry 19 from the aft to the forward end, in sense. A monotonically increasing dependent variable such as the section radius 17 is adequately defined as a function which increases so long as the independent variable such as the position 18 along the control device axis of symmetry 19 also increases.

The specific shot dispersion control device embodied in FIG. 1 has a cylindrical axial recess 11 in the forward terminal end of longitudinal member 12. Individual shot 13 completely surround shot dispersion control device 10 and fill the recess 11. Upon firing, shot dispersion control device 10 will be propelled forward and prior to the shot 13 exiting the recess 11, the filled recess will increase the flight stability of the shot dispersion control device 10 by increasing the transverse moment of inertia which in turn will reduce the yaw and pitch motion of the shot dispersion control device 10.

Stability means 9 also prevents yaw and pitch motion of the shot dispersion control device 10 and provides a high degree of air resistance during flight. In the embodiment shown in FIG. 3*a*. the shot dispersion control device 10 is represented with a phi angle ($\phi_1$) of 6.85°. (The angle between the longitudinal axis of the shot dispersion control device 10 and the sloping element of the outer frusto-conical surface when the outer surface has constant slope.)

A phi angle of 3.15° ($\phi_2$) is shown in the modified embodiment in FIG. 3*b* of the shot dispersion control device 10. This embodiment will spread the shot pattern less due to the smaller phi angle. To a degree, the length of the longitudinal member 12 also has an effect on the shot pattern.

A partial longitudinal sectional view of a 12 gauge shotgun muzzle 14 is shown with one embodiment of a shot dispersion control device 10 immediately before it totally exits muzzle 14 at FIG. 4*a*. The shot 13 remains momentarily in a virtually cylindrical configuration and has not yet begun to spread outwardly.

Figure 4C:
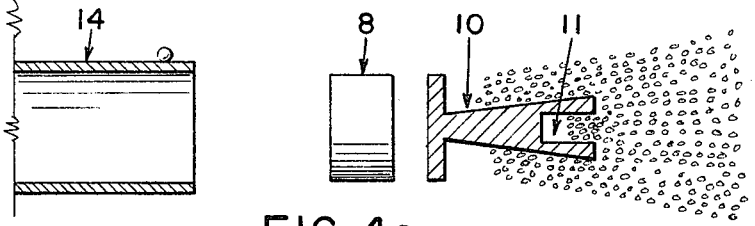

As the time sequence of the fired shot progresses, the pronounced spreading of shot 13 from a cylindrical pattern is schematically portrayed in FIG. 4*c*, and the exiting of shot from the recess 11 of the shot dispersion control device 10 occurs. Also, wadding 8 has now separated from shot dispersion control device 10, and the wadding 8 will shortly terminate its short flight.

Figure 4D:
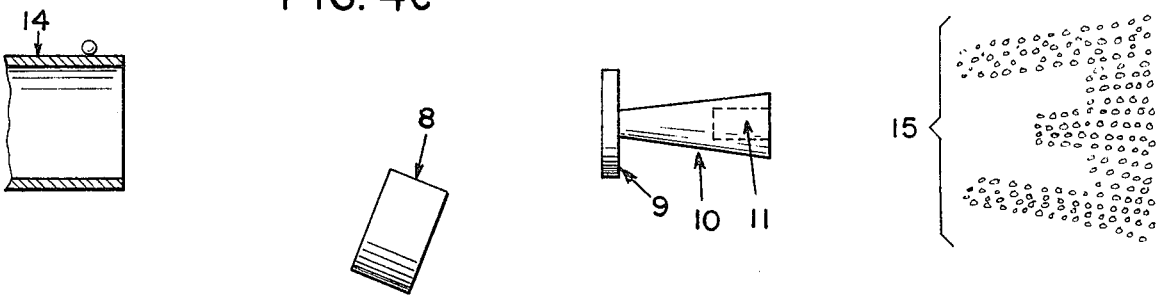

The full effect of the large aerodynamic drag created by the air resistance on the stability means 9 and recess 11 of shot dispersion control device 10 is diagrammatically illustrated in FIG. 4*d*. Also, after the shot 13 has passed the shot dispersion control device 10, a representative shot pattern 15 shows a typical complete shot dispersion control pattern.

As can be seen from the sequence in FIGS. 4*a* through FIG. 4*d*, the shot dispersion control device 10 is capable of quickly spreading the shot pattern due in part to the stability means 9 creating high air resistance.

Hunters will find this invention very helpful and will be able to load their guns, for example, with two or three different phi angle control devices as well as shells without a control device. Therefore, when game such as quail break in flight as the hunter nears, the first shell to be fired would be one containing a large phi angle control device to emit a greatly dispersed shot pattern. If the first shot does not reach its mark, the game will fly away from the hunter prior to the second shot. The hunter may then fire a shell containing a smaller phi angle control device for a less dispersed shot pattern. If by chance the hunter again misses on his second try, he may then fire a third shell which contains no control device for greater pattern density which will increase his chances for a hit.

Colored-coding or some easily recognizable indicia may be readily employed in shell manufacturing to enable one quickly to choose the dispersion desired. Also, this device will be of greatest significance to owners of "full choke" weapons who at times have found great disadvantages in the limitations of their particular gun. By now employing the proper shell selection, a shotgun owner can greatly expand the shot pattern of his "choked" weapon.

Shotgun manufacturers can also benefit from this dispersion device. For now, instead of manufacturing a particular model shotgun with a variety of barrels with different chokes, only one barrel, of full choke design, need be supplied and the user can then select shotgun shells to suit his particular needs. Although this device will only have a small effect when used in shotguns provided with an "improved cylinder" or similar barrels which are designed to spread shot extensively, in a "modified choke" barrel, the effect will be intermediate between that achieved with a "full choke" and an "improved cylinder". Thus, the shot dispersion control device exerts its greatest influence on shot patterns when used with barrels employing the "full choke" design.

It has been determined by firing a 12 guage shotgun with No. 6 shot, with a "full choke" barrel from 40 yards at a 30 inch diameter circle, that 65% of the shot will pass within the circle's circumference when no shot dispersion control device is employed. Similarily, when using a shotgun shell containing a control device with a phi angle of 3.15°. only approximately 48% of the shot pass within the circumference of the circle under the same conditions. By increasing the phi angle of the control device to 6.85° only about 35% of the shot will pass within the circle's circumference. Therefore, most of the desired shot patterns can be achieved with a substantially small number of different shot dispersion control devices.

We claim:

1. A shotgun shell containing a shot dispersion control device comprising; a base casing, a cylindrical body extended from said casing, a powder charge and wadding positioned in said base casing, a shot dispersion control device positioned in said cylindrical body intermediate its length, and shot surrounding said device, said device having stabilizing means at one end thereof, a longitudinal member having a surface of which a major portion monotonically increases from said stability means, said longitudinal member having an end opposite said stability means, said opposite end including a recess therein for receiving shot, whereby shot surrounding said longitudinal member will be dispersed upon firing depending upon the monotonical increase of said longitudinal member's outer surface.

2. A shotgun shell as claimed in claim 1, wherein said longitudinal member comprises a frusto-conical configuration.

3. A shotgun shell as claimed in claim 2, wherein said frusto-conical configuration defines a phi angle between 0° and 45°.

4. A shotgun shell as claimed in claim 1, wherein said recess is cylindrically shaped.

5. A shotgun shell as claimed in claim 1, wherein said shot dispersing control device is integrally formed from plastic and said longitudinal member extends one inch from said stability means.

6. A shotgun shell as claimed in claim 1, wherein said recess is in the forward terminal end of the said longitudinal member.

* * * * *